US006748186B1

(12) United States Patent
Skrainar et al.

(10) Patent No.: US 6,748,186 B1
(45) Date of Patent: Jun. 8, 2004

(54) MODULAR MACHINE HAVING DISTRIBUTED FAULT RECOVERY-ASSIST USER INTERFACES

(75) Inventors: Stephen F. Skrainar, Penfield, NY (US); Stanley H. Brumaghim, Inverness, FL (US); Keith L. Willis, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/314,744

(22) Filed: Dec. 9, 2002

(51) Int. Cl.[7] ..... G03G 15/00
(52) U.S. Cl. ..... 399/81; 399/9; 399/18
(58) Field of Search ..... 399/9, 18, 19, 399/20, 21, 22, 23, 81, 8; 714/2, 26, 49

(56) References Cited

U.S. PATENT DOCUMENTS 5,490,089 A * 2/1996 Smith et al.
6,038,690 A * 3/2000 Jacobson et al.

* cited by examiner

*Primary Examiner*—Hoang Ngo

(74) *Attorney, Agent, or Firm*—Tallam I. Nguti

(57) ABSTRACT

A modular toner image producing machine having plural modules including redundant modules is provided and includes (a) a photoreceptive module including a movable endless photoconductive member having an image bearing surface; (b) toner image forming modules for forming a toner image on the image bearing surface, each of the toner image forming modules including module-specific fault detectors; (c) at least one sheet feeding module for feeding a copy sheet to receive the toner image from the image bearing surface; (d) a fusing module for heating and fixing the toner image onto the copy sheet forming a hard copy; (e) at least one finishing module for preparing and arranging a series of hard copies into sets thereof for removal by an operator; and (f) a control module including a main electronic control system having a centrally located user interface device, and distributed module-specific control subsystems, each having a dedicated module and being connected to the main electronic control system and to module-specific fault detectors of the dedicated module, and each of the module-specific control subsystems having a fault recovery-assist user interface device located at the dedicated module and remotely from the centrally located user interface device for providing in situ recovery-assistance for each the dedicated modules, and for enabling recovery-while-running isolation for a redundant dedicated module.

16 Claims, 4 Drawing Sheets

MODULAR MACHINE HAVING DISTRIBUTED FAULT RECOVERY-ASSIST USER INTERFACES

BACKGROUND OF THE INVENTION

The present invention relates generally to toner image production machines, and more particularly, concerns a modular toner image production machine including distributed module-specific control subsystems having in situ fault recovery-assist user interface devices for providing in situ recovery assistance for remote modules, and for enabling recovery-while-running isolation for redundant modules.

In a typical toner image production machine such as an electrostatographic reproduction machine, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This process records an electrostatic latent image on the photoconductive member corresponding to the informational areas contained within the original document. After the electrostatic latent image is recorded on the photoconductive member, the latent image is developed by bringing a developer material into contact therewith.

Generally, the developer material is made from toner particles adhering triboelectrically to carrier granules. The toner particles are attracted from the carrier granules to the latent image forming a toner powder image on the photoconductive or image bearing member. The toner powder image is then transferred at an image transfer station, from the photoconductive member, to a copy substrate such as a copy sheet of paper.

Thereafter, heat or some other treatment is applied to the toner particles at a fusing station to permanently fuse and affix the toner powder image to the copy sheet or substrate. The copy sheet or substrate typically is fed automatically from a stack supply thereof, along a sheet transport path that includes a sheet registration subassembly, to the image transfer station where the toner image is transferred from the image bearing member onto a first side of the copy sheet. As discussed above, after such toner image transfer, the copy sheet is moved along the sheet path to the fusing station of the machine where the toner image is fused and affixed to the copy sheet. In machines with duplex copying capability, the sheet path usually includes a sheet inverter, and the copy sheet after leaving the fusing station, is inverted at the inverter and refed to the transfer station in proper orientation for receiving a second toner image on a second side of the copy sheet. In either case, the copy sheet with the fused toner image or images on it is then forwarded to an output tray or finishing station. High quality output copies typically require proper and high quality registration of the toner image or images on the copy sheet.

To achieve such registration, the copy sheet must be transported in a timed and registered manner to the sheet registration subassembly and to the transfer station each time, and sheet drive mechanisms along the sheet path have to function without slippage. Presence and proximity sensors can be used for assisting the achievement of such proper and timed registration of each copy sheet. Typically, any failure of a copy sheet being transported along the sheet path to activate any of the above sensors at a control point, in time or space, usually registers as a machine error. Detection of such an error usually results in a copy sheet stall or jam along the sheet path, as well as in a machine shutdown, and in a call or alert for an operator to remove or clear the stalled or jammed copy sheet, wherever it may be, along the sheet transport path.

Sheet handling systems as well as developer material systems within such machines usually come as "works in a drawer" because of the benefits they offer for operator services such as clearing jammed or stalled sheets contained entirely within the subsystem. Such drawer designs are particularly employed for electrostatographic machine subsystems such as the fuser and post-fuser sheet inverter subsystems that ordinarily include hidden sheet paths that are hard or unsafe to access. With such designs, to subsystems such as the fuser, inverter, duplex and/or registration transports are mounted on a drawer or platform on rails and slides which enable the subsystem(s) to be pulled out of, and pushed back into the machine. Typically, each such subsystem includes sensors and switches that may from time to time fail and require service. Additionally, each such subsystem, is made movable in and out of the machine, relative to other fixed portions or components of the machine. As higher and higher speed machines are made to have more and more features and more and more such subsystems or modules, more and more components will become packed within each subsystem or module. As such, problems are very likely to occur stopping production, and the machine ordinarily will need servicing.

Conventionally, when problems occur that cause production to stop prior to successful task completion, as disclosed for example in U.S. Pat. No. 4,500,971, centrally located devices such as the machines main user interface have been suggested for the purpose of providing users with an alarm notification of the problem Such conventional devices may even include more information such as fault status notification as well as instructional support for resolving the problem (e.g. fault recovery information). Typically, in these devices this notification and recovery information is presented through a visual modality for example via an alphanumeric display device.

In large modular machines, the entire machine usually shuts down when there is a need to use the one centrally located User Interface to assist in the recovery of the faulty module. Additionally, in the case of most modules, operators have to step back and forth to constantly review information at a greater risk of misreading errors. Because such large modular machines are located in high volume copy production areas that tend to be very noisy, centrally located auditory warning and information devices are not that much better.

SUMMARY OF THE INVENTION

In accordance with the present invention, there is provided in a modular toner image producing machine having plural modules including redundant modules. The modular toner image producing machine comprises (a) a photoreceptive module including a movable endless photoconductive member having an image bearing surface; (b) toner image forming modules is for forming a toner image on-the image bearing surface, each of the toner image forming modules including module-specific fault detectors; (c) at least one sheet feeding module for feeding a copy sheet to receive the toner image from the image bearing surface; (d) a fusing module for heating and fixing the toner image onto the copy sheet forming a hard copy; (e) at least one finishing module for preparing and arranging a series of hard copies into sets thereof for removal by an operator; and (f) a control module including a main electronic control system having a centrally located user interface device, and distributed module-specific control subsystems, each having a dedicated module and being connected to the main electronic control system and to module-specific fault detectors of the dedicated module, and each of the module-specific control subsystems having a fault recovery-assist user interface device located at the dedicated module and remotely from the centrally located user interface device for providing in situ recovery-assistance for each the dedicated modules, and for enabling recovery-while-running isolation for a redundant dedicated modules.

BRIEF DESCRIPTION OF THE DRAWINGS

Other features of the present invention will become apparent as the following description proceeds and upon reference to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
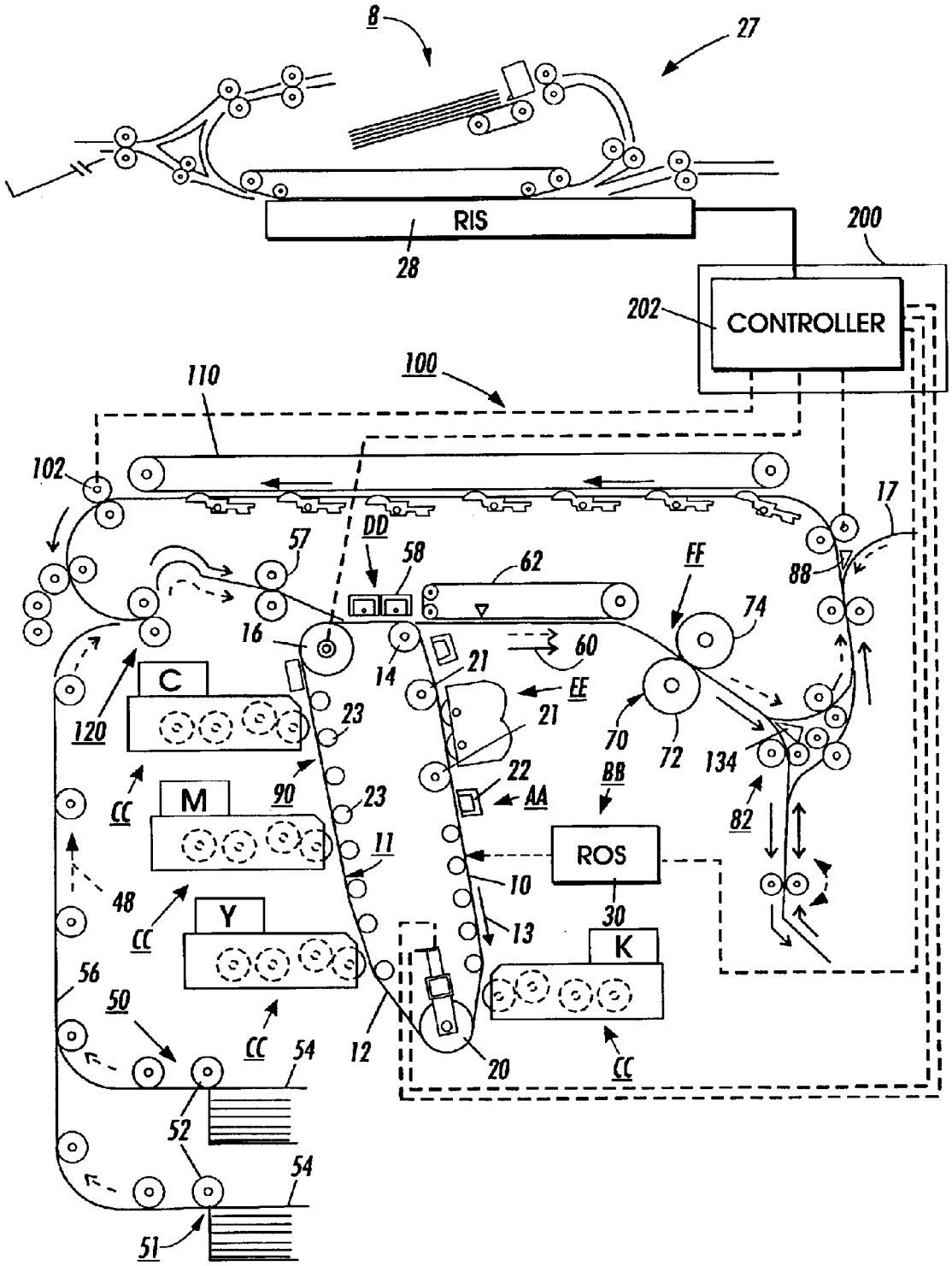
FIG. 1 is a schematic elevational view of a toner image producing machine such as an electrostatographic reproduction machine.

Referring now FIG. 1, it schematically illustrates a toner image producing machine such as a copier, printer, or multifunction device shown in the form of an electrostatographic reproduction machine 8. As is well known, in the machine 8, an original document is positioned in a document handling module 27 on a raster input scanner (RIS) module indicated generally by reference numeral 28. The RIS module 28 for example contains document illumination lamps, optics, a mechanical scanning drive and a charge coupled device (CCD) array. The RIS module 28 operates to capture the entire original document and converts it to a series of raster scan lines. This information is transmitted to a control module 200 of the present invention (to be described in detail below) that includes an electronic subsystem (ESS), 202 that controls a raster output scanner (ROS) 30.

The machine 8 generally employs a photoreceptor module 90 including a photoconductive member shown as a belt 10. Preferably, the photoconductive belt 10 is made from a photoconductive material coated on a ground layer which, in turn, is coated on an anti-curl backing layer. Belt 10 moves in the direction of arrow 13 to advance successive portions sequentially through the various processing stations disposed about the path of movement thereof. Belt 10 is entrained as a closed loop 11 about stripping roll 14, drive roll 16,and idler roll 21.

Initially, a portion of the photoconductive belt surface passes through charging station AA. At charging station AA, a corona generating device indicated generally by the reference numeral 22 charges the photoconductive belt 10 to a relatively high, substantially uniform potential.

Still referring to FIG. 1, at an exposure station BB, the controller or electronic subsystem (ESS) 202, receives image signals from RIS 28 representing the desired output image and processes these signals to convert them to a continuous tone or gray scale rendition of the image which is transmitted to a modulated output generator, for example the raster output scanner (ROS), indicated generally by reference numeral 30.

ROS 30 includes a laser with rotating polygon mirror blocks. Preferably a nine-facet polygon is used. The ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 202. As an alterative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station CC, which includes four development modules as shown each having developer units containing cmyk color toners, in the form of liquid or dry particles. As is well known, the cmyk color toners are electrostatically, attracted to the latent images using commonly known techniques.

With continued reference to FIG. 1, after the electrostatic latent image is developed, the toner powder image present on belt 10 advances to transfer station DD. A print sheet 48 is advanced to the transfer station DD, by a sheet feeding module or apparatus 50, 51. Preferably, sheet feeding apparatus 50, 51 includes a feed roll 52 contacting the uppermost sheet of stack 54. Feed roll 52 rotates to advance the uppermost sheet from stack 54 to sheet transport 56. Sheet transport 56 directs the advancing sheet 48 of support material into registration assembly 57 and then into image transfer station DD to receive a toner image from photoreceptor belt 10 in a timed sequence. The toner image on the image bearing surface 12 of the belt 10 contacts the advancing sheet 48 at transfer station DD. Transfer station DD includes a corona-generating device 58, which sprays ions onto the backside of sheet 48. This attracts the toner image from photoconductive surface 12 to sheet 48. After image transfer as such, sheet 48 continues to move in the direction of arrow 60 by way of belt transport 62, which advances sheet 48 to fusing station FF.

Fusing station FF includes a fusing module indicated generally by the reference numeral 70 which permanently affixes the transferred toner power image to the copy sheet. Preferably, fusing module 70 includes a heated fuser roller 72 and a pressure roller 74 with the powder image on the copy sheet contacting fuser roller 72. The pressure roller is crammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fusing module 70 where the image is permanently fixed or fused to the sheet. After passing through fusing module 70, a gate 88 either allows the sheet to move directly via output 17 to a finisher or stacker, or deflects the sheet into the duplex path 100, specifically, first into single sheet inverter 82 here. That is, if the second sheet is either a simplex sheet, or a completed duplexed sheet having both side one and side two images formed thereon, the sheet will be conveyed via gate 88 directly to output finishing modules (260, 262 FIG. 2) via output path 17.

However, if the sheet is being duplexed and is then only printed with a side one image, the gate 88 will be positioned to deflect that sheet into the inverter 82 and into the duplex loop path 100, where that sheet will be inverted and then fed to acceleration nip 102 and belt transports 110, for recirculation back through transfer station DD and fusing module 70 for receiving and permanently fixing the side two image to the backside of that duplex sheet, before it exits via exit path 17.

After the print sheet is separated from photoconductive surface 12 of belt 10, the residual toner/developer and paper fiber particles adhering to photoconductive surface 12 are removed therefrom at cleaning station EE. Cleaning station EE includes a rotatably mounted fibrous brush in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

As shown FIGS. 1–4, the reproduction machine 8 includes a control module 200 including the electronic control subsystem (ESS) 202 having a centrally located user interface (UI) 204 and the distributed modulespecific control subsystems 210, 212, 214, 216, of the present invention. The distributed module-specific control subsystems 210, 212, 214, 216 of the present invention are suitable for providing in situ recovery assistance for remote modules, and for enabling recovery-while-running isolation for redundant modules. Each of the control units such as 202, 210, 212, 214, 216 can be a self-contained, dedicated minicomputer or programmable microprocessor which can be programmed to provide various controls including for example a comparison count of the copy sheets, the number of documents being recirculated, the number of copy sheets selected by the operator, time delays. In particular they can be programmed in accordance with the present invention to provide machine stoppage fault and corrective information.

Thus the control module 200 includes (for example in the ESS 202), at least one self-contained, dedicated minicomputer having a central processor unit (CPU) 220, memory devices 222, 224, and a main centrally located display or user interface (UI) device 204. The control module 200 (including the ESS 202), with the help of sensors Si, switches Ti and connections, can read, capture, prepare and process image data as well as machine status and module-specific fault information in accordance with the present invention.

Figure 2:
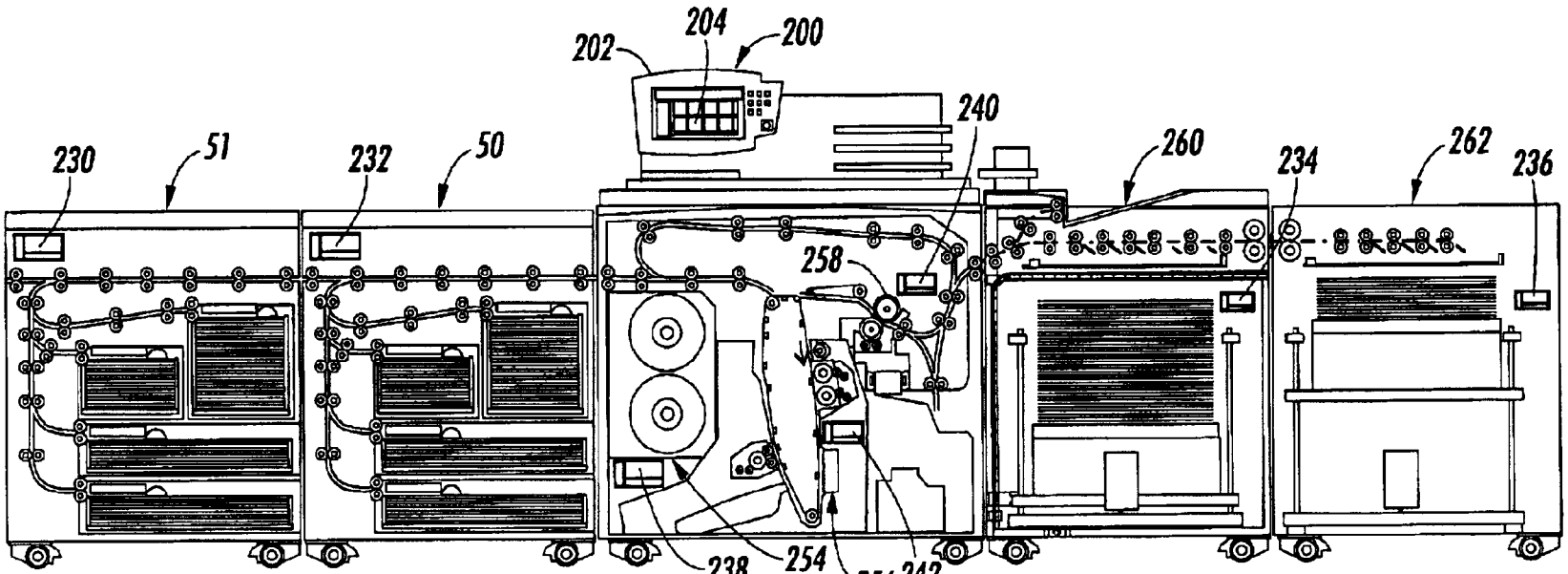
FIG. 2 is a schematic front elevational view of an exemplary modular toner image producing machine, having distributed fault recovery-assist user interface devices in accordance with the present invention.

Referring in particular to FIG. 2, the modular machine 8 for example has sheet feeding modules 50, 51 that are redundant, development module 254 and photoreceptor module 256. It also includes fusing module 258, and hard copy finishing modules 260 and 262 that are also redundant in the machine as shown. The machine 8 of course also includes the control module 200 that itself includes the distributed fault recovery-assist user interface devices 230, 232, 234, 236, 238, 240, 242 for providing in situ recovery-assistance for each of the dedicated modules, and for enabling recovery-while-running isolation for a redundant dedicated module. The control module 200 as such is suitable for providing visual and auditory messaging from to assist a user in the operation of the by providing at the point of need (in situ), fault nature and fault recovery information and instructions. This system as such could be used in high noise environments by both visually auditory impaired operators.

Figure 3:
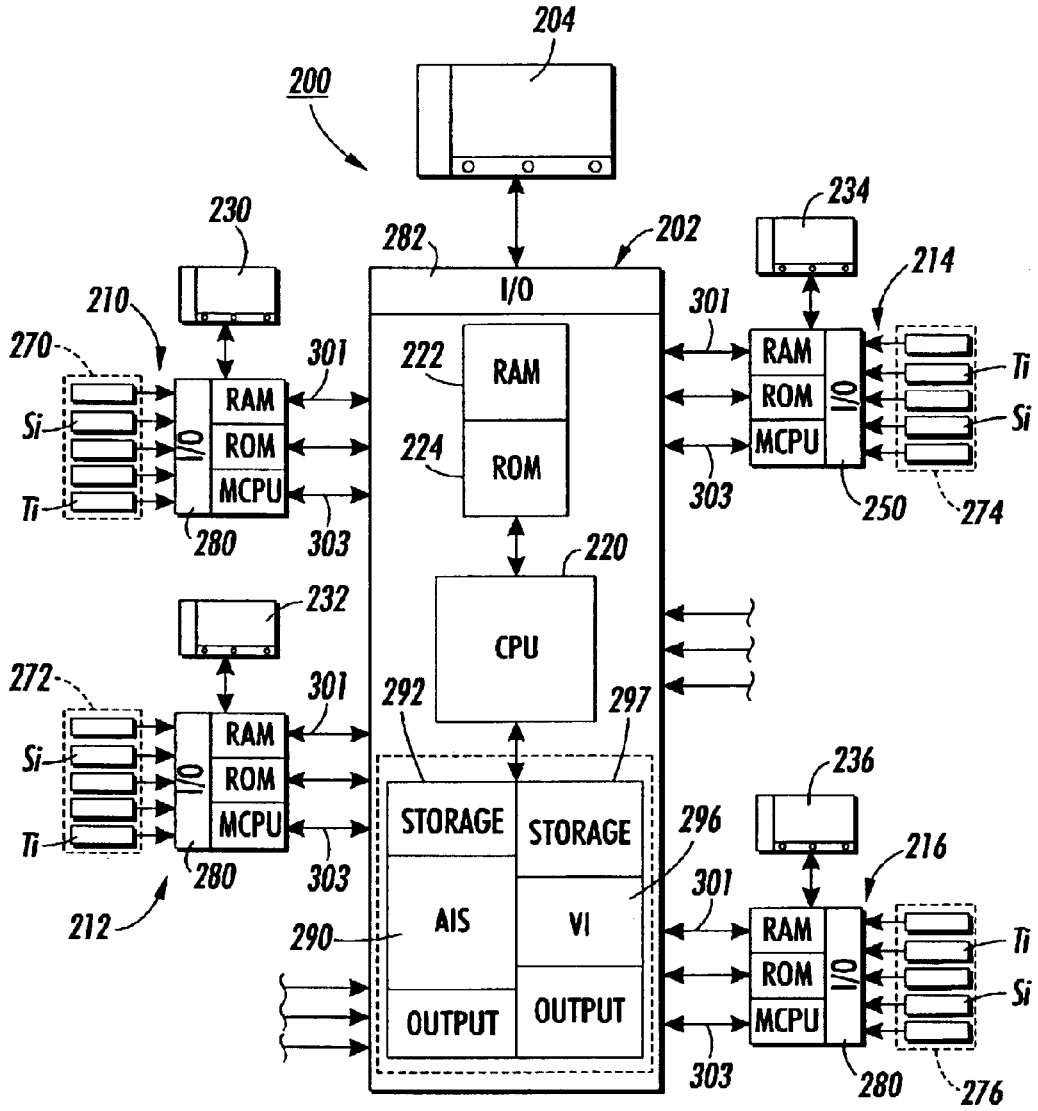
FIG. 3 is a block diagram illustration of the control module of the machine of FIG. 2 including the distributed fault recovery-assist user interface devices in accordance with the present invention.

Referring in particular to FIG. 3, a block diagram of the control module 200 of the toner image producing machine 8 is illustrated, and includes the distributed module-specific control subsystems 210, 212, 214, 216, etc. according to the present invention. As illustrated, in addition to the distributed module-specific control subsystems 210, 212, 214, 216, etc., the control module 200 includes the main electronic control system ESS 202 having the centrally located user interface 204.

As further shown, each of the distributed module-specific control subsystems 210, 212, 214, 216, etc. has a dedicated module (FIG. 2) 50, 51, 254, 256, 258, 260, 262, and is suitable for providing in situ fault identification and recovery assistance for each such the dedicated module. Each of the distributed module-specific control subsystems 210, 212, 214, 216, etc is connected to the electronic control system 202 and to module-specific fault detecting means 270, 272, 274, 276 of the dedicated module. As shown, each the module-specific control subsystems 210, 212, 214, 216, etc., has a fault recovery-assist user interface device 230, 232, 234, 236, 238, 240, 242 located at the dedicated module, as well as and remotely from the centrally located user interface device 204. Location of the fault recovery-assist user interface devices 230, 232, 234, 236, 238, 240, 242 as such is suitable for enabling recovery-while-running isolation for redundant dedicated modules 50, 51 and 260, 262, for example.

Still referring to FIG. 3, the module-specific fault detecting means 270, 272, 274, 276 may comprise (in anyone of the redundant finisher modules 260, 262) a paper jam detector Ti, out of registration detector, level violation sensor Si, stacker tray jam detector, as are well known. In other modules, the module-specific fault detecting means (Ti and Si) may include appropriately a paper-out detector, a toner insufficiency detector, a document left-out detector, a reset button no-depression detector, a no key counter detector, a top cover "open" detector etc.

In each dedicated module 50, 51, 254, 256, 258, 260, 262, the module-specific fault detecting means 270, 272, 274, 276 is connected to the main electronic control system 202 through an input/output interface section 280. The central processing unit or CPU 220 is programmable for controlling the overall operation of all modules and other operating components of the machine 8. The ROM section 224 stores sequence programs for the machine operations including some control programs for the audio information synthesizing (AIS) section 290 and for the visual information processing section 296 of the present invention.

The random access memory RAM section 222 stores data required in the CPU 220, and an input/output I/O control section 282 for controlling the input and output of signals or data from the module-specific fault detecting means.

The AIS section or stored audio information synthesizing means 290 for example comprises an auditory information data storage section 292, and a synthesizer control section 292 which itself may be a microprocessor. In operation, in response to a detected fault input by the module-specific fault detecting means 270, 272, 274, 276, the AIS section 290 reads out corresponding audio information from the information storage section 292 and then synthesizes the read information on the basis of pre-programmed instructions that are part of the main electronic control system 202 or of the module-specific control subsystem 210, 212, 214, 216. The audio information synthesized thus is then converted to voice form, and transmitted via audio means 301 to the audio output section or speaker 306 (FIG. 4) of the fault recovery-assist user interface devices 230, 232, 234, 236, 238, 240, 242 in accordance with the present invention.

Similarly, in response to the same detected fault inputs by the module-specific fault detecting means 270, 272, 274, 276, the visual information section 296 reads out corresponding visual information from a visual information storage section 297 on the basis of pre-programmed instructions that are part of the main electronic control system 202 or of the module-specific control subsystem 210, 212, 214, 216. The visual information read thus is then displayed or transmitted via means 303 to the visual output section 308 (FIG. 4) of the fault recovery-assist user interface devices 230, 232, 234, 236, 238, 240, 242 in accordance with the present invention.

Figure 4:
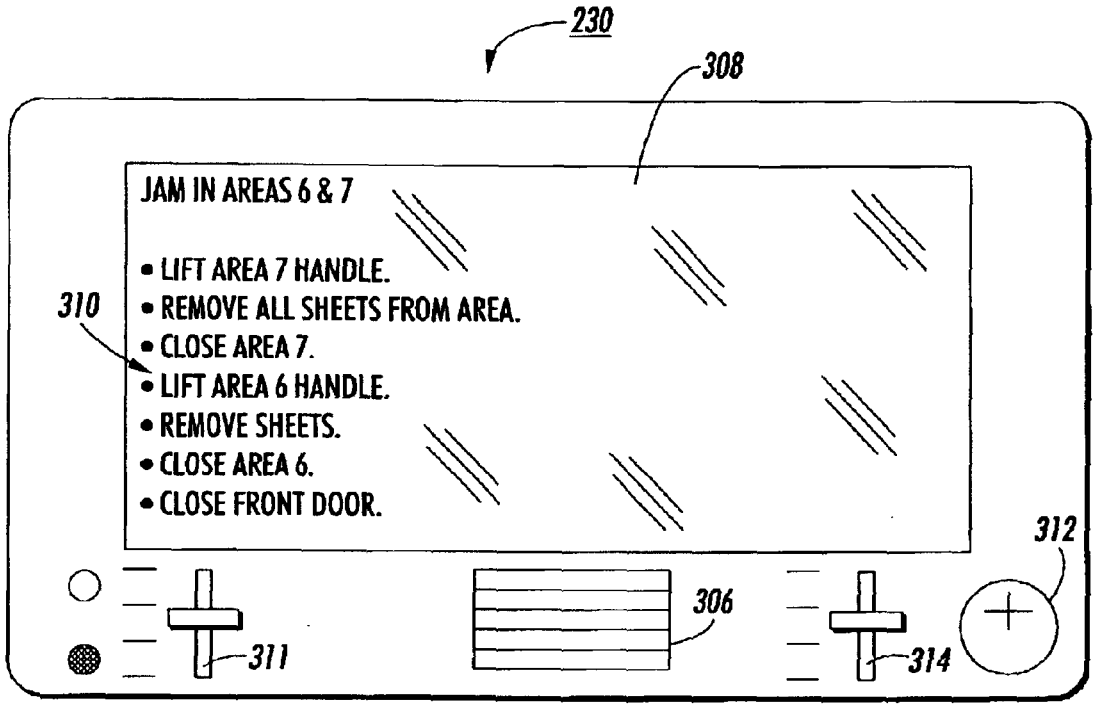
FIG. 4 is a front view illustration of an in situ fault recovery-assist user interface device of the present invention.

As further shown in FIG. 4, each fault recovery-assist user interface device 230 (232, 234, 236, 238, 240, 242), includes a display area or visual output section 308 for displaying recovery instructions 310 as shown and a brightness control element 311. Each fault recovery-assist user interface device 230 (232, 234, 236, 238, 240, 242), also includes an audio information selection button 312 for playing and replaying audio messages including recovery instructions and a volume control element such as a bar 314. The fault information (identification and recovery) is automatically transmitted to the fault recovery-assist user interface device 230 (232, 234, 236, 238, 240, 242) of the affected module, but is also available at the main user interface 204. Such fault information is available simultaneously as visual information (which can be made the default mode of display), and as auditory information for selective activation.

Such fault information, managed by the control module 200, at least includes machine and machine module identification, fault identification and description, and if prompted by the operator, instructions for recovery. Upon successful performance of recovery instructions, the machine provides feedback automatically confirming successful recovery. Thus any occurrence of a fault that causes a production shutdown is automatically detected and transmitted in both the visual modality and auditory modality to the fault recovery-assist user interface device 230 (232, 234, 236, 238, 240, 242) of the affected module.

The operator can then control the information, for example at the fault recovery-assist user interface device 230 (232, 234, 236, 238, 240, 242) of the affected module by (1) going along with a default visual display or selecting audio display mode, (2) a request for the next message leading toward fault recovery, (3) a "repeat last message" control, (4) a "repeat all messages" control, and (5) a loudness or brightness control depending on the lighting or noise level of the machine location.

As such, the system is capable of providing pre-recorded voice messages and instructions on an as needed basis to an operator for assisting the operator in the process of a machine fault recovery. A module-specific audio message thus can be delivered automatically when the module door for example was opened, or it can be delivered only when a control button such as 312 located in each module is activated to provide a current fault related module-specific message. As is well known, such messages can easily be adapted to be in any language depending on the location of the machine or on the preferred language of the operator.

Other advantages for the operator include: (1) remote indication of a fault which protects against environmental noise and ensures that the message is heard as well as seen, and (2) ability to monitor multiple printing stations and modules simultaneously.

As can be seen, there has been provided a modular toner image producing machine having plural modules including redundant modules. The modular toner image producing machine comprises (a) a photoreceptive module including a movable endless photoconductive member having an image bearing surface; (b) toner image forming modules for forming a toner image on the image bearing surface, each of the toner image forming modules including module-specific fault detecting means; (c) at least one sheet feeding module for feeding a copy sheet to receive the toner image from the image bearing surface; (d) a fusing module for heating and fixing the toner image onto the copy sheet forming a hard copy; (e) at least one finishing module for preparing and arranging a series of hard copies into sets thereof for removal by an operator; and (f) a control module including a main electronic control system having a centrally located user interface, and distributed module-specific control subsystems, each having a dedicated module and being connected to the main electronic control system and to module-specific fault detecting means of the dedicated module, and each of the module-specific control subsystems having a fault recovery-assist user interface located at the dedicated module and remotely from the centrally located user interface for providing in situ recovery-assistance for each the dedicated modules, and for enabling recovery-while-running isolation for a redundant dedicated module.

While the invention has been described with reference to the structure herein disdosed, it is not confined to the details as set forth and is intended to cover any modification and changes that may come within the scope of the following claims.

We claim:

1. A modular toner image producing machine having plural modules including redundant modules, said modular toner image producing machine comprising:

(a) a photoreceptive module including a movable endless photoconductive member having an image bearing surface;

(b) toner image forming modules for forming a toner image on said image bearing surface, each of said toner image forming modules including module-specific fault detecting means, and a distributed module-specific control subsystem having a fault recovery-assist user interface device;

(c) at least one sheet feeding module for feeding a copy sheet to receive said toner image from said image bearing surface;

(d) a fusing module for heating and fixing said toner image onto said copy sheet forming a hard copy;

(e) at least one finishing module for preparing and arranging a series of hard copies into sets thereof for removal by an operator; and (f) a control module including a main electronic control system having a centrally located user interface device, and each said distributed module-specific control subsystem, each said distributed module-specific control subsystem having a dedicated module and being connected to said main electronic control system and to module-specific fault detecting means of said dedicated module, and each of said module-specific control subsystems having said fault recovery-assist user interface device located at said dedicated module and remotely from said centrally located user interface device for providing in situ recovery-assistance for each of said dedicated modules, and for enabling recovery-while-running isolation for a redundant dedicated module.

2. The modular machine of claim 1, wherein said main electronic control system includes an audio information storage section.

3. The modular machine of claim 1, wherein said main electronic control system includes a visual information storage section.

4. The modular machine of claim 1, wherein said main electronic control system includes stored audio information synthesizing means.

5. The modular machine of claim 1, wherein said main electronic control system includes a main central processing unit (CPU).

6. The modular machine of claim 1, wherein said main electronic control system includes a main random access memory (RAM) section.

7. The modular machine of claim 1, wherein each distributed module-specific control subsystem includes a module central processing unit (MCPU).

8. The modular machine of claim 1, wherein each distributed module-specific control subsystem includes a random access memory (RAM) section.

9. The modular machine of claim 1, wherein each distributed module-specific control subsystem includes a read-only memory (ROM) section.

10. The modular machine of claim 1, including means for simultaneously transmitting detected fault information in visual and auditory mode to an affected dedicated module.

11. The modular machine of claim 1, wherein each said fault recovery-assist user interface device located at each said dedicated module includes a display area for displaying fault information visually.

12. The modular machine of claim 1, wherein each said fault recovery-assist user interface device located at each said dedicated module includes a speaker for outputting synthesized voice fault information.

13. The modular machine of claim 1, wherein each said fault recovery-assist user interface device located at each said dedicated module includes control means for selectively displaying fault information in one of a visual mode and an audio mode.

14. The modular machine of claim 11, wherein each said display area for displaying fault information visually includes a brightness control element.

15. The modular machine of claim 12, wherein each said fault recovery-assist user interface device located at each said dedicated module includes a volume control element.

16. The modular machine of claim 13, wherein at each said fault recovery-assist user interface device located at each said dedicated module said visual mode is a default mode for displaying fault information.

* * * * *